United States Patent [19]

Sacks

[11] Patent Number: 4,774,724

[45] Date of Patent: Oct. 4, 1988

[54] PROTECTIVE GARMENTS

[76] Inventor: Michael Sacks, 14 Bury Old Road, Prestwich, Manchester, England

[21] Appl. No.: 76,121

[22] Filed: Jul. 21, 1987

Related U.S. Application Data

[63] Continuation of Ser. No. 921,941, Oct. 20, 1986, abandoned, which is a continuation of Ser. No. 720,141, Apr. 5, 1985, abandoned.

[51] Int. Cl.[4] ..... F41H 1/02
[52] U.S. Cl. ..... 2/2.5
[58] Field of Search ..... 2/2.5

[56] References Cited

U.S. PATENT DOCUMENTS 4,497,069 2/1985 Braun Hut ..... 2/2.5

*Primary Examiner*—Louis K. Rimrodt
*Attorney, Agent, or Firm*—Pearson & Pearson

[57] ABSTRACT

A protective garment, such as a bullet-proof vest, has multiple layers of penetration-resisting aramid fabric within an outer cover. A trauma pack is mounted on the garment to reinforce the protective action of the aramid fabric layers. The trauma pack is detachably mounted so that the garment can be used with or without the pack in position. Within the trauma pack there is a sheet of impact-absorbing plastics material, particularly a polycarbonate sheet, and this may be backed with a foamed plastics layer.

3 Claims, 1 Drawing Sheet

PROTECTIVE GARMENTS

Figure 1:
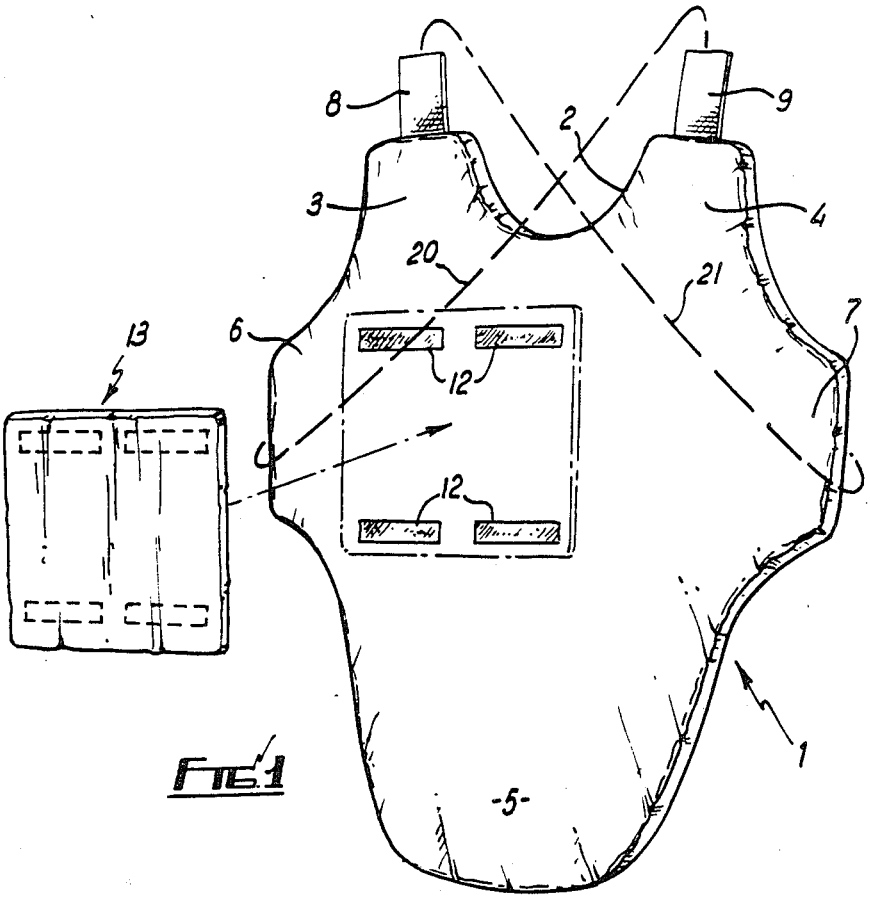

This is a continuation of my application Ser. No. 921,941, filed Oct. 20, 1986, which is a continuation of my application Ser. No. 720,141, filed Apr. 5, 1985, both abandoned.

This invention relates to protective garments, particularly of the bullet-proof vest kind, and is more specifically concerned with a backing structure for addition to an existing protective garment to improve its efficacy.

It is well known to construct bullet-proof vests from multiple layers of fabric woven from an aramid fibre which is sold by Du Pont under the Trade Mark KEVLAR. This material combines high penetration resistance with lightness and flexibility.

Where protection is required against a low level of threat (i.e. relatively small calibre, low velocity bullets) it is possible to achieve this with a Kevlar vest structure which can be worn comfortably and unobtrusively. Where protection is required against a higher level of threat the problem arises that an increase in the number of Kevlar layers is accompanied by a corresponding increase in bulk and stiffness. In this respect it is to be understood that to avoid injury to the wearer the Kevlar layers should not only prevent passage of the bullet but also prevent or at least limit appreciable rear bulging which can cause injury by transmitted shock or trauma.

My U.K. Pat. Nos. 1,556,245, 2061089, European Pat. No. 28476 and U.S. Pat. No. 4,413,357 describe the use of a trauma pack which is incorporated in a bullet-proof vest behind the usual Kevlar layers. With this arrangement protection against a high level of threat can be achieved without necessarily requiring an unduly thick pack of Kevlar layers. This is because the trauma pack, as described, acts to reinforce the stopping action of the Kevlar layers and spread the shock over a relatively wide area. However, the trauma pack is, in effect, permanently incorporated within the vest whereby a person may be deterred from wearing the vest in low risk situations in so far as the trauma pack inevitably adds something to the bulk and stiffness of the vest if adequate allowance is to be made for higher levels of threat. There is also the problem that an existing owner of a non-reinforced Kevlar vest (i.e. not including the trauma pack of the aforesaid prior Patents) may be loth to replace this with a reinforced Kevlar vest especially having regard to the relatively high cost of the Kevlar material.

In theory there is the possibility of incorporating the trauma pack as a removable insert whereby the pack can be removed or inserted as required to suit low and high threat levels. This however is not a solution which readily recommends itself if due consideration is given to the manner in which the trauma pack is believed to function. Thus, the trauma pack as described in the aforementioned prior Patents comprises a semi-rigid sheet of polycarbonate plastics material accompanied by a sheet of foamed plastics material. It will be appreciated that these materials do not have intrinsic bullet-proof characteristics. Rather, it is believed that the action of the trauma pack is to yield by deformation in a controlled manner such as to spread an impact force, by deflection of its main thrust, over a relatively wide area. This gives rise to two important benefits—firstly, in so far as there is partial penetration of the Kevlar layers the resulting rear bulge is spread thereby to minimise the effect of the impact on the body of the wearer, and secondly, the penetration of the Kevlar layers is contained and restricted because the trauma pack exerts a supportive action which holds the Kevlar layers tightly together and spreads sideways and therefore reduces the effect of the impact of the bullet within the Kevlar material. Accordingly, it is to be expected that effective action can only result if the trauma pack is held firmly in a predetermined position in face-to-face contact with the Kevlar layers. It is not to be expected therefore that effective reinforcing action will be obtained to any appreciable extent if the trauma pack is incorporated as a loose removable insert.

In accordance with the present invention it has been realised that the benefits of ready adaptability to suit low and high threat levels, and which as explained seem elusive in the hypothetical context of a removably incorporated insert, can in fact be readily attained in a particularly effective manner by use of a self-contained trauma pack which can be firmly yet removably mounted at a predetermined position on the outer surface of an existing self-contained protective garment.

More specifically the invention provides a protective garment to be worn by a person comprising multiple layers of penetration-resisting aramid fabric contained within an outer cover and defining in itself a self-contained protective garment suitable for protecting against low levels of threat, first fixing devices being provided on an external surface of the said cover which surface when the garment is worn faces towards the body of the wearer, and a self-contained trauma pack comprising multiple layers, at least one of which comprises a sheet of impact-absorbing plastics material, enclosed within a bag, second fixing devices being provided on an external surface of said bag, and said first and second fixing devices being detachably cooperable with each other to hold said trauma pack firmly yet removably in contact with said external surface of said garment cover.

With this arrangement it will be appreciated that the garment can be readily adapted for different threat levels by removing or attaching the trauma pack. Also there is the advantage that the trauma pack can be applied to an existing protective garment to upgrade the protective function thereof in a particularly convenient and inexpensive manner.

With regard to the garment this may take any suitable form. It is visualised that the invention will find particular application in relation to a garment which constitutes a vest front part which is held in position on the wearer's body by straps, and/or by attachment to a vest back part. However, the invention is not restricted to this and may be applied to other kinds of garment.

As to the trauma pack, this may be of any suitable size and shape and may be located on the garment at any suitable position. Thus, the pack may extend over a major part of the area of the garment, or at least of that area of the garment which is coextensive with the aramid layers, thereby to support the action of the aramid layers throughout. Alternatively, the pack may extend only over a minor part of the area of the garment e.g. corresponding to a region of the wearer's body, such as the heart region, where optimum protection is important.

The fixing devices may take any suitable form although fixing devices of the kind sold under the Trade Mark VELCRO and comprising respective multiple hook and loop structures are particularly advantageous.

The trauma pack may incorporate, in addition to at least one polycarbonate sheet, at least one resiliently deformable foamed plastics sheet and preferably also at least one sheet of woven aramid fabric. The layers of the trauma pack may be united, if desired, by stitching or bonding or otherwise as appropriate.

Figure 2:
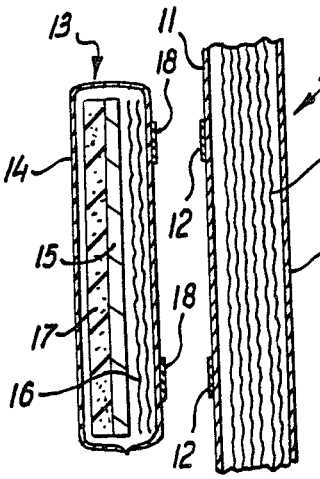

The invention will now be described further by way of example only and with reference to the accompanying drawings in which:

FIG. 1 is a diagrammatic exploded rear perspective view of one form of a garment according to the invention; and FIG. 2 is an exaggerated sectional view of part of the garment of FIG. 1.

With reference to FIG. 1 there is shown a protective garment in the form of a bullet-proof vest. The garment comprises a shaped structure 1 generally corresponding to the front part of a vest. The front part is worn by a person by positioning this in front of the person's body. In this respect it will be noted that the front part has a curved neck recess 2, two upper shoulder projections 3, 4, a lower groin projections 5, and two side projections 6, 7. The front part 1 is held in position by means of tabs 8, 9 at the top of the shoulder parts 3, 4 which are fastened, over the person's shoulders, to a back part extending behind the person's back. This back part may simply comprise straps 10, 11 (indicated by broken lines) which are fixed to the side projections 6, 7. Alternatively the back part may be a protective structure of like form to the front structure and having top tabs which connect with the tabs 8, 9 and side portions which connect with the side projections 6, 7. Interconnection with the tabs 8, 9 and the side projections 6, 7 may be effected via Velcro fasteners or otherwise as desired. Reference is made to U.S. Pat. No. 4,413,357 for a further description of a suitable construction for the garment.

The garment front part 1 comprises multiple layers of Kevlar woven fabric sheets 10 contained within a fabric cover 11 (e.g. a nylon cover). The fabric sheet 10 may constitute kevlar 29 or 49 closely woven with 31—31 (warp and weft) picks per inch from 1000 or 1500 denier yarn. There may be say eight to 30 sheets and these may be stitched together and/or bonded together e.g. in pairs. Kevlar is the trade name of an aramid fibre being of high tensile strength and high stretch resistance. The Kevlar layers 10 preferably are of identical size and shape and extend throughout the area of the front part 1. The resulting front part 1 is semi-stiff but is capable of limited flexibility e.g. to the extent that the side projections 6, 7 can bend round the sides of the wearer's body.

On the outside of the rear face of the front part 1 i.e. the face which in use faces towards the wearer's body there are fixed Velcro fastener strips 12 of the kind having multiple loops.

As indicated in the drawing, a trauma pack 13 is provided for attachment to the front part. This trauma pack 13 comprises a closed nylon bag 14 containing one or two (or more if desired) thin flexible semi-stiff polycarbonate sheets 15 such as that sold under the trade name LEXAN, the or each such sheet being of 0.75 mm thickness. At one side of the polycarbonate sheet 15 there is a small number of sheets 16 of the above described woven Kevlar fabric (say two sheets). At the other side there is one (or more if desired) resiliently compressible sheet 17 of a foamed plastics material. A foamed cross-linked polyethylene such as that sold under the trade name PLASTIZOTE or EVAZOTE may be used. The total thickness of the plastics sheet or sheets 17 may be say 5 mm to 12 mm. Thicker Lexan up to 1.25 mm or more may be used.

The various layers within the bag 14 may be stitched and/or bonded together as desired and as appropriate.

On the outside of the face of the bag adjacent the Kevlar layers 16 there are fixed Velcro fastener strips 18 of the kind having multiple hooks.

The layers within the trauma pack 13 are all of like size and shape and are rectangular whereby the trauma pack itself is of like rectangular shape.

In use, the garment can be worn without the trauma pack 13 and when so worn provides protection against a low level threat in conventional manner. When desired, the trauma pack 13 can be attached to the rear face of the front part 1 by engaging the Velcro strips 18 on the trauma pack 13 with the Velcro strips 12 on the garment, it being understood that the two sets of strips 12, 18 are of similar size and spacing.

The positioning of the trauma pack 13 when mounted on the garment as described is such that additional protection is afforded in the region of the wearer's heart. In this respect, although the trauma pack 13 is separate from the main body of Kevlar material 10 it is possible to achieve a significant supportive and reinforcing action because the construction and mode of attachment of the trauma pack 13 to the garment 1 ensures that the same firm intimate contact is maintained between the layers of the pack 13 with the Kevlar layers 10 as would be the case if the pack 13 were incorporated directly within the garment in the known manner.

Particular benefits stem from the fact that the pack 13 extends only over a minority of the area of the garment 1. In this way optimum protection against fatal injury can be achieved without unduly increasing bulk and stiffness. The Velcro fastener strips 12, 18 may be relatively long to enable the positioning of the pack to be adjusted within limits. It is also possible to provide multiple regions of Velcro fastener strips 18 on the vest so that the pack can be selectively mounted at different positions and/or so that two or more packs 13 can be mounted as desired.

It is of course to be understood that the invention is not intended to be restricted to the details of the above embodiment which are described by way of example only. Thus, for example, it will be appreciated that fasteners other than Velcro strips may be used and the pack and garment may be shaped and constructed other than as specifically described.

In the above example, the trauma pack is shown in conjunction with a protective garment structure of the kind having Kevlar layers enclosed with a nylon bag with the pack attached to such bag. It is also possible to use the pack with a protective garment structure of the kind having Kevlar layers enclosed within a bag defined by outer Kevlar sheets which are stitched or otherwise fixed together at their peripheries, the pack being attached to the rearward facing outer Kevlar sheet. With the latter arrangement at least the outer Kevlar sheets are normally required to possess waterproof properties at least to a certain extent. With the former arrangement no such restrictions are imposed on the Kevlar layers in so far as protection against moisture is derived from the nylon bag. In each case it will be appreciated that the protective garment structure in question (i.e. the Kevlar layers enclosed within the nylon bag or the Kevlar layers enclosed within seated outer Kevlar layers) would normally be enclosed within an outer fabric cover formed from any suitable material of the kind used in flack jackets, battledresses etc. and in this case the trauma pack would preferably also be contained within the outer cover. The straps 9, 10 may be provided on the outer cover if desired.

Moreover, in the foregoing the trauma pack is shown as containing two sheets of Kevlar fabric. The action of this is to upgrade the Kevlar-derived stopping power of the vest 1. As desired more layers (say up to six or seven) may be provided. Alternatively, these layers may be omitted and/or substituted by nylon layers.

What is claimed is:

1. A protective garment to be worn by a person comprising:

a first semi-stiff part having multiple layers of penetration resisting aramid fabric extending throughout the entire first part contained within an outer cover having a front and a rear surface and defining in itself a self-contained protective garment suitable for protecting against low levels of threat;

first fixing devices being provided on an external surface of said cover which surface, when the garment is worn faces towards the body of the wearer;

a second separate detachable self-contained part comprising a semi-stiff trauma pack extending only over a minority of the area of said garment and attached to the exterior rear surface of the cover for protecting against high levels of threat by spreading the impact or force by deflection thereby limiting any appreciable rear buldging which would cause injury by transmitting shock or trauma;

said semi-stiff pack being enclosed in a nylon bag having a front and rear surface and containing multiple layers of protective material wherein:

the first said layer is of kevlar fabric at the front of the nylon bag and closest to the semi-stiff part;

a second layer is a thin flexible semi-stiff polycarbonate sheet having sides and being about 0.75 mm in thickness and acting as a reinforcing layer of protective material attached to and supporting the top layer of kevlar fabric sheets;

a third layer comprises a plurality of compressible foamed plastic material sheets acting as a reinforcing layer, attached and supporting the second layer of flexible semi-stiff polycarbonate sheets;

second fixing devices on the front surface of said bag containing said trauma pack and said first and second fixing devices being detachably cooperable with each other to hold said trauma pack firmly yet removable in face to face contact with said inwardly facing surface of said cover.

2. A garment as specified in claim 1 wherein the thickness of the foamed plastic sheet is between 5 mm and 12 mm.

3. A garment as specified in claim 1 wherein the fixing devices comprise respective multiple hook and loop structures.

* * * * *